US008833319B2

(12) United States Patent
Kraus

(10) Patent No.: US 8,833,319 B2
(45) Date of Patent: Sep. 16, 2014

(54) VALVE TRAIN WITH CAMSHAFT WITH AN AXIALLY DISPLACEABLE CAM UNIT

(75) Inventor: Christian Kraus, Wernigerode (DE)

(73) Assignee: ThyssenKrupp Presta TecCenter AG, Eschen (LI)

( * ) Notice: Subject to any disclaimer, the term of this patent is extended or adjusted under 35 U.S.C. 154(b) by 576 days.

(21) Appl. No.: 13/050,598

(22) Filed: Mar. 17, 2011

(65) Prior Publication Data

US 2011/0226205 A1 Sep. 22, 2011

(30) Foreign Application Priority Data

Mar. 18, 2010 (DE) ..... 10 2010 011 897

(51) Int. Cl.
*F01L 1/34* (2006.01)
*F01L 13/00* (2006.01)
*F01L 1/047* (2006.01)

(52) U.S. Cl.
CPC ..... *F01L 1/047* (2013.01); *F01L 13/0036* (2013.01); *F01L 2013/0052* (2013.01)
USPC ..... 123/90.18; 123/90.15; 123/90.16

(58) Field of Classification Search
USPC ..... 123/90.15, 90.16, 90.17, 90.18
See application file for complete search history.

(56) References Cited

U.S. PATENT DOCUMENTS

| | | | | |
|---|---|---|---|---|
| 7,404,383 | B2 * | 7/2008 | Elendt | 123/90.16 |
| 7,409,938 | B2 * | 8/2008 | Dengler | 123/90.18 |
| 8,297,247 | B2 * | 10/2012 | Schoeneberg et al. | 123/90.18 |
| 2005/0011480 | A1 * | 1/2005 | Schultz et al. | 123/90.16 |
| 2007/0034184 | A1 | 2/2007 | Dengler | |

FOREIGN PATENT DOCUMENTS

| | | | |
|---|---|---|---|
| DE | 42 30 877 | A1 | 4/1993 |
| DE | 10 2004 011 586 | A1 | 10/2004 |
| DE | 10 2007 040 677 | A1 | 3/2009 |
| DE | 10 2008 020 892 | A1 | 10/2009 |
| EP | 0 798 451 | B1 | 4/1999 |

* cited by examiner

*Primary Examiner* — Thai Ba Trieu
*Assistant Examiner* — Thomas Olszewski
(74) *Attorney, Agent, or Firm* — Crowell & Moring LLP

(57) ABSTRACT

A valve train for an internal combustion engine includes a camshaft with a cam unit for actuating a gas exchange valve. The cam unit has at least two cam paths arranged axially one behind the other and is arranged on the camshaft in a rotation-resistant and axially displaceable manner, and has an actuating profile interacting with a displaceable actuating element between a home position and an actuating position radially to the axis of the camshaft for axially displacing the cam unit on the camshaft. The actuating profile is formed by the lateral front face of the cam unit, and the actuating element has at least one displaceable actuating pin that interacts with a lateral front face of the cam unit such that an axial displacement of the cam unit takes place and in each axial position a different cam path is activated to actuate the gas exchange valve.

8 Claims, 1 Drawing Sheet

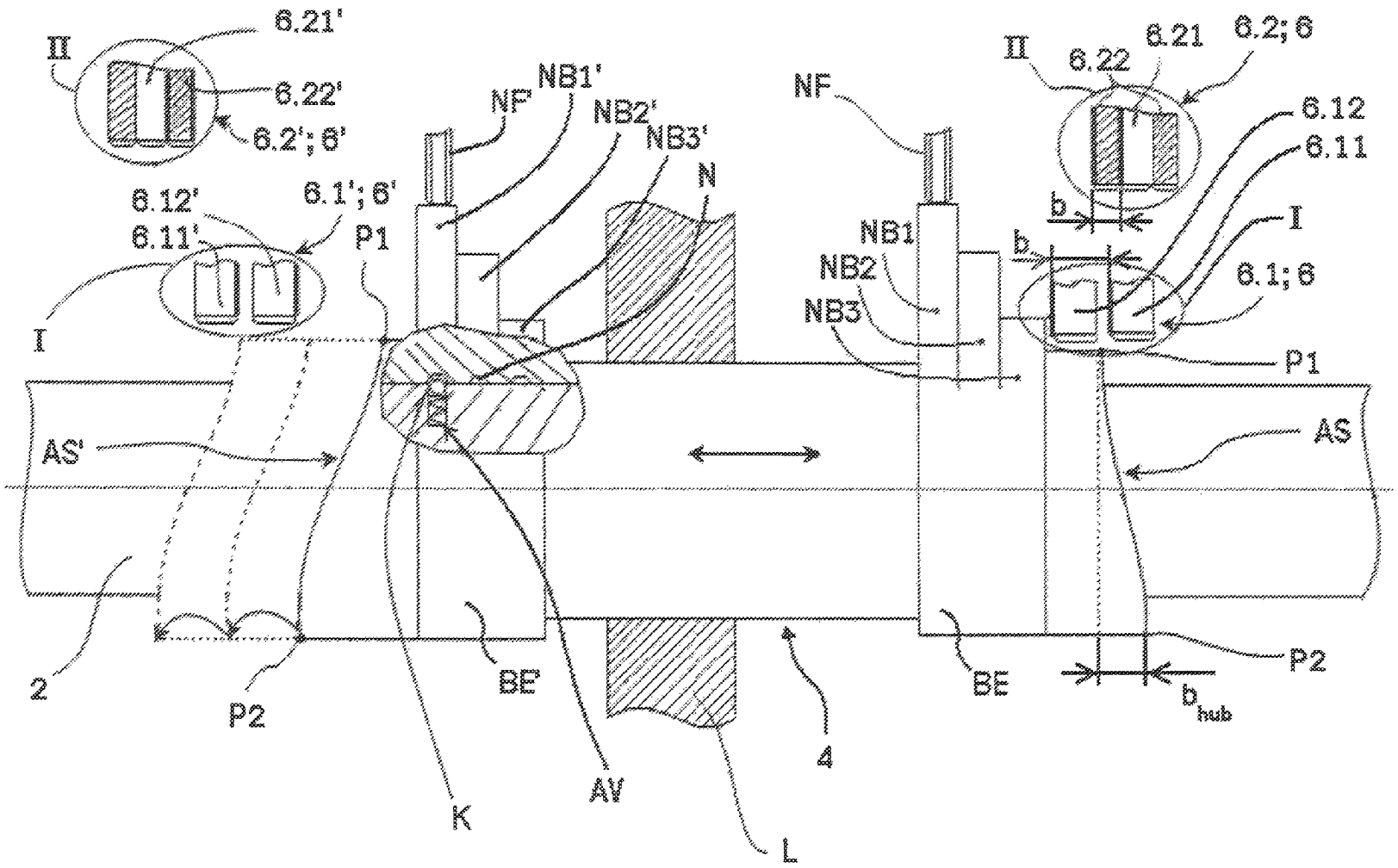
6.2;6
6.21
6.22
II
6.12
6.11
I
6.1;6
P1
AS
P2
$b_{hub}$
b
b
BE
NF
NB1
NB2
NB3
4
L
N
NB3'
NB2'
NB1'
NF'
AV
BE'
K
P1
6.1';6'
6.21'
6.22'
6.2';6'
6.12'
6.11'
II
I
AS'
P2
2

VALVE TRAIN WITH CAMSHAFT WITH AN AXIALLY DISPLACEABLE CAM UNIT

CROSS REFERENCE TO RELATED APPLICATION

This application claims priority under 35 U.S.C. §119 to German Patent Application No. 10 2010 011 897.4-13, filed Mar. 18, 2010, the entire disclosure of which is herein expressly incorporated by reference.

BACKGROUND AND SUMMARY OF THE INVENTION

Exemplary embodiments of the present invention relate to a valve train for an internal combustion engine with a cam unit arranged on a camshaft in a rotation-resistant and axially displaceable manner.

The function of a camshaft is to control the gas exchange valves of an internal combustion engine. In order to be able to carry this out as efficiently as possible and depending on operating parameters of the internal combustion engine, today's camshafts have in part axially displaceable cam units with several different cam (stroke) profiles. The different cam (stroke) profiles of the cam units, which act on the respective gas exchange valve, are thereby characterized in a different manner or embodied with a different stroke (course) and in extreme cases have no marked stroke curve (zero stroke), but merely a basic circle radius, which renders possible a selective cylinder switch off.

EP 0 798 451 B1 discloses a valve train having a camshaft with cams for actuating gas exchange valves, wherein at least one cam is provided with several cam paths arranged axially one behind the other and arranged in a rotation-resistant but axially displaceable manner on the camshaft. The cam has a so-called stroke profile, which interacts with an actuating element for displacing the cam, wherein the stroke profile is embodied on the cam and the actuating element has an actuating pin, which is to be brought into engagement with the stroke profile in a displaceable manner radially to the camshaft. In the illustrated exemplary embodiment the cam has a total of three cam paths arranged next to one another, wherein the cam, starting from a central operating position in which the central cam path is active, is displaceable by one step to the left or by one step to the right. For this purpose, the cam has respectively one stroke curve on its two outer cylindrical ends. By engagement of a first actuating pin assigned to its stroke curve on the front side, the cam can thereby be displaced in a first axial displacement direction, and can be displaced back against this working direction again via a second actuating pin, which interacts on the opposite end of the cam with another stroke curve.

DE 42 30 877 A1 discloses a cam block arranged on a camshaft in a rotation-resistant and axially displaceable manner with two cam paths arranged axially next to one another, wherein, for the purpose of the axial displacement of the cam block, this cam block interacts with its contoured front face with the contoured front face of an adjacent pressure ring, as soon as the pressure ring is blocked via a catch hook engaging radially in the pressure ring.

DE 10 2004 011 586 A1 discloses another embodiment of an axially displaceable cam unit having several cam paths arranged next to one another.

Exemplary embodiments of the present invention provide a valve train for an internal combustion engine, which valve train guarantees a very specific control of the internal combustion engine depending on different operating parameters and is thereby structurally embodied such that the necessary installation space inside the internal combustion engine is reduced compared to embodiments hitherto known or can be sized as small as possible. Furthermore, exemplary embodiments of the present invention provide cam units with more than two axially adjacent different cam path profiles in a space-saving manner.

A valve train according to the invention comprises a camshaft with a cam unit supported in a rotation-resistant and axially displaceable manner for actuating a gas exchange valve, wherein the cam unit has at least two cam paths arranged axially one behind the other (one next to the other). In one aspect of the present invention the cam unit has a plurality n of cam paths where $n \geq 3$. Furthermore, the cam unit according to the invention has an actuating profile, which interacts with an actuating element that is displaceable between a home position and an actuating position radially to the axis of the camshaft (and arranged in a stationary manner in a housing part of the internal combustion engine) for the purpose of the (stepwise) axial displacement of the cam unit on the camshaft. According to the invention, the actuating profile of the cam unit is formed by the lateral front face thereof. According to the invention, the actuating element of the cam unit is embodied as with an (in particular as with a plurality (n−1) of) actuating pin(s) displaceable in the radial direction between the home position and the actuating position, wherein the at least one actuating pin interacts with the lateral front face of the cam unit such that an axial lateral displacement of the cam unit on the camshaft takes place. In each position of the cam unit a different cam path is thereby activated for actuating the gas exchange valve (or in each step a different cam path to actuate the gas exchange valve interacts with the cam follower for actuating the gas exchange valve).

In different, further aspects of the present invention the actuating element can have either a plurality of separate actuating pins (individually displaceable in a radial manner) arranged axially (directly) next to one another or a plurality of actuating pins (individually displaceable in a radial manner) arranged coaxially to one another. It is essential to the invention thereby that the (effective) actuating area provided by the actuating element (or by the individual actuating pins thereof), arranged on one side of the cam unit and interacting with the lateral front face of the cam unit through the switching of the at least one actuating pin, is shifted or moves once—or preferably multiple times in the same displacement direction.

The cam unit can have a corresponding actuating profile on both lateral front faces, so that a separate actuating element, in particular switchable in a multiple-step manner, is respectively assigned to both lateral front faces of the cam unit. This ensures forced guidance or forced displacement in both displacement directions. Alternatively, the cam unit can have an actuating profile interacting with the actuating element on only one front face, and on its other front face can be embodied in an essentially planar manner and can be acted on with a spring force via a spring element (return spring) against the displacement direction. The invention is explained in more detail below based on an exemplary embodiment shown in a drawing FIGURE.

BRIEF DESCRIPTION OF THE DRAWINGS

The sole FIGURE is a diagram illustrating, in section, a camshaft 2 with a cam unit 4 arranged thereon. The cam unit 4 is arranged supported on the camshaft 2 in a rotation-resistant and axially displaceable manner in the conventionally known manner. The cam unit 4 has at least one actuator element BE embodied as a multilobe cam and interacting with a cam follower NF.

DETAILED DESCRIPTION OF THE DRAWINGS

In the exemplary embodiment shown, the cam unit 4 has a total of two actuator elements BE, BE' spaced apart from one another axially and embodied as multilobe cams for the simultaneous actuation of two inlet or outlet gas exchange valves of a cylinder of an internal combustion engine. The two adjacent actuator elements BE, BE' are connected to one another via a connecting body (in particular in one piece) embodied in an annular cylindrical manner. The camshaft 2 is arranged in the region of the cam element 4 in a rotatable manner via the connecting body thereof in a bearing support L of a ladder frame or of a cylinder head. The cam unit 4 is arranged in the bearing support L in a displaceable manner (indicated by the double arrow) as a displacement cam device to adjust different cam stroke profiles. Advantageously, each multilobe cam of the cam unit 4 has a total of at least two (three in the exemplary embodiment shown) different cam paths (cam stroke profiles) NB1, NB2, NB3; NB1', NB2', NB3'. Furthermore, the cam unit 4 in the exemplary embodiment shown has on the front on both axial ends an actuating profile (or a stroke profile acting in the axial direction), which is formed by the respectively lateral front face AS, AS' of the cam unit 4. For the purpose of the axial displacement of the cam unit 4 on the camshaft 2, an actuating element 6 (6.1; 6.2); 6' (6.1'; 6.2') with radially extendible actuating pins 6.11, 6.12; 6.21, 6.22; 6.11', 6.12'; 6.21', 6.22' is provided, which advantageously is connected to a housing part of the internal combustion engine and is thus arranged/positioned in a stationary manner to the camshaft 2.

The actuating element 6 (6.1; 6.2); 6' (6.1', 6.2') is shown by way of example in two different embodiments.

In a first embodiment the actuating element 6 (6.1); 6' (6.1') can have a plurality of separate actuating pins 6.11, 6.12; 6.11', 6.12' arranged axially next to one another and individually switchable (radially displaceable/extendible) (lower embodiment of the actuating element—Section 1). In an alternative embodiment of the actuating element 6 (6.2); 6' (6.2'), the actuating element has a plurality of individually switchable actuating pins 6.21, 6.22'; 6.21', 6.22' arranged coaxially to one another (radially displaceable/extendible) (upper embodiment of the actuating element—Section II).

The components acting in the same manner and available twofold in the exemplary embodiment shown (for the axial displacement of the cam unit 4 on both sides) are labeled uniformly with the same reference numbers, wherein the components for the return (or the adjustment back into the starting position shown) are designated with the prime sign. For greater clarity, the mode of operation of the invention is described primarily with reference to the reference numbers without the prime sign. The prime sign reference numbers are used only with the description of the restoring mode of operation.

The actuation or displacement of the cam unit 4 supported on the camshaft 2 in a rotation-resistant and axially displaceable manner is carried out by an actuating element 6.1; 6.2, as described above in two different alternative embodiments. The curve path (open on the edge side) of the cam unit 4 formed by the lateral front face AS allows, through interaction with an actuating pin (or by actuation by means of an actuating pin) 6.11, 6.12; 6.21, 6.22, axially displacement of the cam unit 4 on the camshaft 2 by the stroke width $b_{hub}$ or by the stroke of the front curve path. For this purpose, the front face AS and actuating elements 6.1; 6.2 are embodied and arranged relatively to one another such that it is ensured that the cam follower NF interacts at the time of the axial displacement caused by the interaction of the actuating element 6.1; 6.2 and front face AS with the common base circle region of the cam unit 4. The effective actuating surfaces of the actuating pins 6.11, 6.12; 6.21, 6.22 of the actuating element 6 (6.1; 6.2) are spaced apart axially from one another by a width b, which also essentially corresponds to the individual width of a cam widths NB1, NB2, NB3, as well as essentially to the axial stroke width $b_{hub}$ of the actuating profile. The front curve path of the cam unit 4 is thereby embodied such that, as illustrated in a plan view according to the sole FIGURE, the cam unit 4 starting from a point P1 of the smallest axial width in the course of the front curve path based on a rotation of 180 degrees is widened by the spacing or the stroke width $b_{hub}$ in point P2. Advantageously, the point P1 of the smallest axial width and the apex of at least one cam stroke of the multilobe cam coincide, seen in a circumferential manner.

Starting from an operating position shown in the sole FIGURE, in which the cam unit 4 is displaced axially into its right end position and thus the cam path NB1 located furthest left interacts with the cam follower NF, the cam unit 4 can be displaced axially to the left in a stepwise manner (in this case: in two steps) so that optionally it can be switched from the cam path NB1 with the largest cam stroke to a cam path NB2 with an average valve stroke or a cam path NB3 with a small valve stroke (for example, also a zero stroke). For this purpose in the embodiment shown, the actuating pins 6.11, 6.12; 6.21, 6.22 of the actuating element 6.1; 6.2 on the right side of the cam unit 4 (wherein starting from the operating position shown a displacement to the left is to take place) are arranged above (or radially spaced apart from) the cam unit 4 such that a first actuating pin 6.11; 6.21 in point P1 of the smallest axial width in the case of its extension interacts with the lateral front face AS (curve path) of the cam unit 4, and that a second actuating pin 6.12; 6.22—arranged with its effective actuating area seen in the axial displacement direction directly (to the left) next to the first actuating pin 6.11; 6.21—in the case of its extension cannot engage with the front curve path, but rather would come to rest on the cylindrical section of the cam unit 4 (without a displacement-effective profile engagement). In another embodiment (not shown) of the cam unit 4, the cylindrical section between the outer cam path NB3 and the point P1 with the smallest axial width can be omitted, so that the point P1 directly adjoins the outer cam path NB3 (that is, is shifted inwards by the width of the cylindrical section).

For the purpose of the displacement of the cam unit 4 from the right end position shown to the left in the displacement direction, the first actuating pin 6.12; 6.21 located on the outside to the right (or the actuating pin, the effective actuating area (actuating area shown respectively by a thick line) facing towards the front face AS that is located the furthest to the right) is extended radially in the direction of the camshaft axis, so that with the rotation of the camshaft 2 it then interacts with its effective actuating area with the front curve path of the cam unit 4. With the actuating pin 6.11; 6.21 radially extended, the axial displacement of the cam unit 4—starting from the position shown—starts only after a rotation of the camshaft 2 about approx. 90°. At this point in time the cam follower is then already in the common base circle region of the right actuating element (multilobe cam) BE, so that an axial displacement in the displacement direction to the left can take place. As soon as a displacement of the cam unit 4 by a stroke width $b_{hub}$ has taken place based on the camshaft rotation (of 180°), the cam unit 4 can be locked in the displacement position reached in which, with its central cam path NB2, it interacts with the cam follower NF. For this purpose, a corresponding locking device AV is integrated in the camshaft shaft of the camshaft 2. In the exemplary embodiment shown the locking device AV is formed by a ball K supported in the interior of the camshaft 2 against a spring force, which ball for the purpose of the locking interacts with a profile groove N assigned to the respective cam path NB1, NB2, NB3. Starting from the central cam path position (NB2), the cam unit 4 can be shifted by a further step (by the stroke width $b_{hub}$) in the same displacement direction (in this case: to the left). For this purpose, the second actuating pin 6.12; 6.22, arranged with its actuating area directly next to the first actuating pin 6.11; 6.21 seen in the displacement direction, is radially extended so that with its actuating area it interacts with the lateral front face AS of the cam unit 4 and displaces this cam unit by a further step (of the stroke width $b_{hub}$) to the left (into the left end position or stop position).

For the purpose of the restoration of the cam unit 4 from an operating position shifted by one position/step to the left into the original starting position to the far right, the cam unit 4 can be acted on by a spring unit (return spring) (not shown). In this case the locking would not be formed as shown by a ball K acted on by a pressure spring, which ball interacts with a profile groove N, but by controllable/switchable controllable locking elements, which are, for example, hydraulically actuatable, which interact with corresponding openings of the cam unit 4 assigned to the cam paths NB1, NB2, NB3.

In the exemplary embodiment shown, a restoration of the cam unit 4 (from the center position or the left end position described above) in the other axial displacement direction to the right via a second actuating element 6' (6.1'; 6.2') (arranged on the left) is provided. For this purpose, the cam unit 4 on its opposite side (in this case, its left lateral front face AS') has a front face AS' (curve path) embodied in particular in a mirror symmetrical manner to the front face AS of the right side. This curve path interacts (analogously to the actuator embodiment on the right side) with a actuating element 6' (6.1'; 6.2'), which has either a plurality of actuating pins 6.11', 6.12' arranged axially next to one another and individually switchable, or a plurality of actuating pins 6.21', 6.22' arranged coaxially to one another and individually switchable.

In order to guarantee a force guided return or an axial return shift of the cam unit 4, based on the starting position shown (cam unit 4 in the right stop position), the actuating element 6.1'; 6.2' assigned to the opposite front face AS' of the cam unit 4 is arranged in an axially stationary manner in the housing of the internal combustion engine such that its actuating pin 6.12'; 6.22' for the restoration from the central cam path position NB2 (or from the position of the cam unit 4 shifted one step to the left) with its (effective) actuating area facing towards the lateral front face AS' is spaced apart in the axial direction by at least one axial stroke width $b_{hub}$ from the point P1' with the smallest axial width of the front face curve path. Since the point P1' of the smallest axial width of the curve path and its point P2' with the greatest axial width are likewise spaced apart axially by the stroke width $b_{hub}$, the actuating pin 6.12'; 6.22 (actuating pin for the restoration of the cam unit 4 displaced from the right end position by one step to the left) closest to the cam unit 4 is arranged with its effective area such that, with the radial displacement of the actuating pin 6.12'; 6.22' (with the axial right end position of the cam unit 4), at each angle of rotation of the camshaft 2 no engagement of the actuating pin 6.12'; 6.22' with its effective actuating area on the front curve path of the lateral front face AS' of the cam unit 4 takes place. The actuating pin 6.11'; 6.21' for the restoration after two-step displacement to the left (or restoration from the left stop position) is arranged with its effective actuating area spaced apart by approximately twice the stroke width $b_{hub}$ from the point P1' of the smallest axial width of the cam unit 4.

Starting from an axial end position in which the cam unit 4, as shown in FIG. 1, is displaced to the far right (right end position), the cam unit 4 can be displaced by one step to the left by an actuation of the actuating pin 6.11; 6.21, which is located with its effective actuating area on the outside to the right and which as the only one in the shown position can be brought into engagement with the front curve path of the lateral front face AS. For this purpose, the actuating pin 6.11; 6.21 is displaced or extended radially in the direction of the camshaft axis, so that with a rotation of the camshaft 2, the actuating pin 6.11; 6.21 with its effective area interacts with the front curve path of the cam unit 4 and displaces the cam unit 4 by one step (which essentially corresponds to the stroke width $b_{hub}$) to the left. Starting from this operating condition, in which the cam unit 4 is displaced by one step (to the left) and is fixed by a locking device AV described above, the cam unit 4 can be moved by one further position to the left by an actuation of the left actuating pin 6.12 or the actuating pin 6.22, embodied as the outer coaxial ring pin, of the actuating element 6.12; 6.2 arranged on the right side, so that the cam unit 4 with its cam path NB3 with the smallest valve stroke is in engagement with the cam follower NF.

If the cam unit 4, based on this axial (left) end position now adopted, in which the cam unit 4 is displaced to the far left, is to be displaced to the right again, an actuation of the actuating element 6.1'; 6.2 of the left side must be carried out in the reverse order in that in a first step the actuating pin 6.11'; 6.21' lying to the left outside with its effective actuating area is extended and with its effective area is brought into engagement with the front curve path of the lateral front face AS' on the left side of the cam unit 4, so that a displacement by a stroke width $b_{hub}$ into an operating position occurs, in which the cam unit 4 is in engagement with the central cam path NB2. Analogously hereto, in a second step by actuation of the actuating pin 6.12' lying with its effective actuating area on the right (inside) or of the outer coaxial actuating pin 6.22' (coaxial ring pin) on the left side of the cam unit 4 a further displacement by one position to the right into the right stop position can occur.

The exemplary embodiment shown in FIG. 1, in which the cam unit 4 as a whole has two actuating elements (multilobe cams) spaced apart from one another with a total of three cam path profiles NB1, NB2, NB3, is only one possible embodiment of the invention. Alternatively, a cam unit 4 with likewise only one actuating element BE or with more than two actuating elements BE with different cam profile paths NB1, NB2, NB3 (also with two or more than three different cam profile paths) can be provided, in which either a front edge-open curve path is provided on a lateral front face AS or a front, open curve path is provided on both sides (AS; AS').

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A valve train for an internal combustion engine comprising:

a camshaft with a cam unit that actuates a gas exchange valve, wherein the cam unit has at least two cam paths arranged axially one behind the other and is arranged on the camshaft in a rotation-resistant and axially displaceable manner, and has an actuating profile, which interacts with an actuating element displaceable between a home position and an actuating position radially to the axis of the camshaft to axial displace the cam unit on the camshaft, wherein the cam unit has a lateral front face on its outermost periphery in an axial direction, wherein the actuating profile is formed by the lateral front face of the cam unit, and wherein the actuating element to displace the cam unit from one axial position into another axial position has at least one actuating pin that is displaceable in the radial direction between the home position and the actuating position, wherein rotation of the cam unit causes the actuating pin to interact with the lateral front face such that an axial displacement of the cam unit takes place, wherein in each axial position a different cam path is activated to actuate the gas exchange valve.

2. The valve train according to claim 1, wherein the cam unit has at least three cam paths arranged axially one behind the other, and the actuating element has a plurality of actuating pins for multiple-step displacement of the cam unit.

3. The valve train according to claim 1, wherein the actuating element has a plurality of separate actuating pins arranged axially next to one another.

4. The valve train according to claim 1, wherein the actuating element has a plurality of actuating pins arranged coaxially to one another.

5. The valve train according to claim 1, wherein the cam unit has an actuating profile on both lateral front faces, and a separate actuating element is respectively assigned to both lateral front faces.

6. The valve train according to claim 1, further comprising:

a locking device for temporary locking of the cam unit in different axial positions, wherein in each axial position a cam follower is in engagement with a different cam path of the cam unit, and wherein the cam unit is formed by a force positive connection between the camshaft and the cam unit.

7. The valve train according to claim 1, wherein the actuating profile is open on an edge side of the cam unit.

8. The valve train according to claim 1, wherein the actuating profile has a curved path on the lateral front face of the cam unit.

* * * * *